US008342828B2

(12) United States Patent
Wicht

(10) Patent No.: US 8,342,828 B2
(45) Date of Patent: Jan. 1, 2013

(54) SEAL FOR A ROTARY VANE PUMP

(75) Inventor: John L. Wicht, Big Bend, WI (US)

(73) Assignee: Rapco, Inc., Hartland, WI (US)

( * ) Notice: Subject to any disclaimer, the term of this patent is extended or adjusted under 35 U.S.C. 154(b) by 659 days.

(21) Appl. No.: 12/512,508

(22) Filed: Jul. 30, 2009

(65) Prior Publication Data

US 2010/0034685 A1 Feb. 11, 2010

Related U.S. Application Data

(60) Provisional application No. 61/086,655, filed on Aug. 6, 2008.

(51) Int. Cl.
*F03C 4/00* (2006.01)
*F04C 15/00* (2006.01)
*F04C 2/00* (2006.01)

(52) U.S. Cl. ..... 418/133; 418/104; 418/143; 418/149; 418/259; 277/560; 277/568

(58) Field of Classification Search ..... 418/104, 418/131, 133, 143, 149, 259; 277/529, 530, 277/567, 553, 568, 589, 584, 560
See application file for complete search history.

(56) References Cited

U.S. PATENT DOCUMENTS

| | | | | |
|---|---|---|---|---|
| 2,473,139 | A * | 6/1949 | Dickerman | 277/500 |
| 3,825,270 | A * | 7/1974 | Paramonoff et al. | 277/568 |
| 3,995,868 | A * | 12/1976 | Smith | 277/560 |
| 4,363,491 | A * | 12/1982 | Secor | 277/385 |
| 6,287,094 | B1 * | 9/2001 | Bleitz et al. | 417/440 |

* cited by examiner

*Primary Examiner* — Theresa Trieu
(74) *Attorney, Agent, or Firm* — Michael Best & Friedrich LLP

(57) ABSTRACT

A pump includes a housing and a shaft rotatable about an axis. The shaft has a shaft diameter and has a portion disposed within the housing. A plurality of retractable vanes is coupled to the shaft and each vane includes a first end that contacts the housing. A seal element is positioned to define a seal between the shaft and the housing. The seal element includes a first bushing, a second bushing, and a dry seal assembly including a wiper that defines a diameter that is smaller than the shaft diameter.

18 Claims, 6 Drawing Sheets

SEAL FOR A ROTARY VANE PUMP

RELATED APPLICATION DATA

This application claims benefit under 35 U.S.C. Section 119(e) of U.S. Provisional Application No. 61/086,655, filed Aug. 6, 2008, which is fully incorporated herein by reference.

BACKGROUND

The invention relates to a shaft seal for a pump. More particularly, the present invention relates to a shaft seal for a rotary vane pump.

Rotary vane pumps can be used in aircraft to provide vacuum for the various instruments used for navigation and control. Typically, aircraft rotary vane pumps are positioned within the engine compartment where they are exposed to hydrocarbons and hydrocarbon vapors such as oil, engine exhaust, fuel, etc.

SUMMARY

The present invention provides a shaft seal assembly for a rotary vane pump. The shaft seal assembly includes a wiper that contacts the shaft seal and maintains a seal therebetween. The shaft seal assembly also includes an O-ring that contacts the pump housing to bias the wiper into contact with the shaft and also provides a seal between the shaft seal assembly and the pump housing. The shaft seal assembly can be used in new pumps and can also be installed in prior art pumps including a conventional shaft seal bushing.

In one construction, the invention provides a pump that includes a housing and a shaft rotatable about an axis. The shaft has a shaft diameter and has a portion disposed within the housing. A plurality of retractable vanes is coupled to the shaft and each vane includes a first end that contacts the housing. A seal element is positioned to define a seal between the shaft and the housing. The seal element includes a first bushing, a second bushing, and a dry seal assembly including a wiper that defines a diameter that is smaller than the shaft diameter.

In another construction, the invention provides a pump that includes a housing that defines a pump space and a seal space and a shaft that includes a seal portion positioned adjacent the seal space. A rotor is coupled to the shaft and is rotatable about a rotational axis with the shaft and a plurality of vanes is retractably supported by the rotor. Each vane includes a first end that contacts the pump space. A first bushing is positioned between the shaft and the housing within the seal space and a second bushing is positioned between the shaft and the housing within the seal space. The second bushing is spaced a non-zero distance along the axis from the first bushing. A wiper is disposed between the first bushing and the second bushing. The wiper includes an innermost surface that contacts the shaft and an outermost surface spaced a non-zero distance from the housing. A biasing member is positioned between the wiper and the shaft and is in contact with the outermost surface of the wiper and the housing to bias the wiper toward the shaft.

In yet another construction, the invention provides a method of repairing a rotary vane pump. The method includes removing a bearing disposed in a bearing space having a first axial length, the bearing positioned adjacent a shaft having an outer surface and a housing having an inner surface. The method also includes inserting a first bushing having an inside surface that substantially seals against the outer surface of the shaft and an outer surface that seals against the inner surface of the housing and inserting a second bushing having an inside surface that substantially seals against the outer surface of the shaft and an outer surface that seals against the inner surface of the housing. The method further includes positioning a wiper between the first bushing and the second bushing, the wiper having an innermost surface in contact with the outer surface of the shaft and an outermost surface spaced from the inner surface of the housing, the first bushing, the second bushing, and the wiper cooperating to define a second axial length that is about equal to the first axial length, and biasing the wiper toward the shaft to compensate for wear of the wiper.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
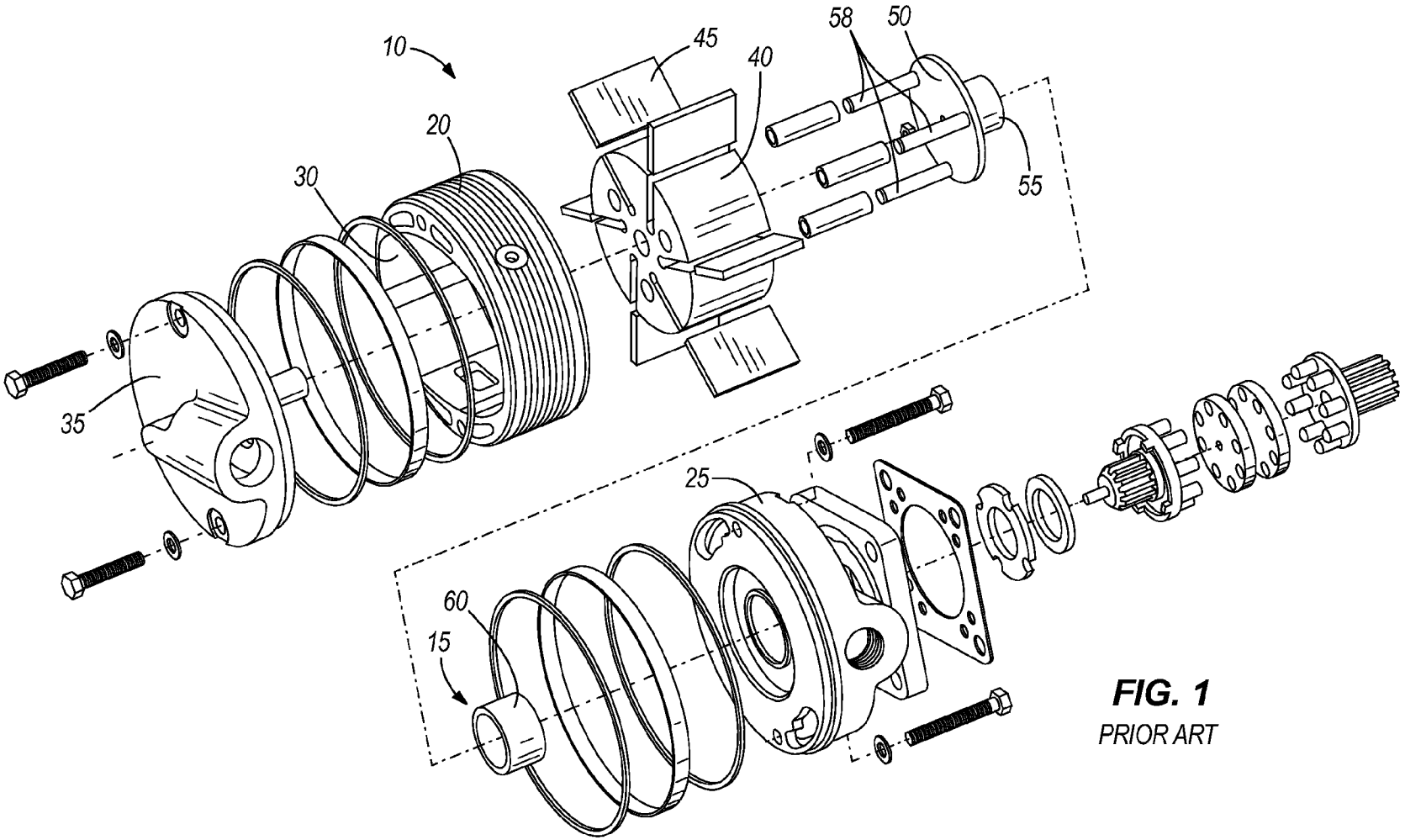
FIG. 1 PRIOR ART
FIG. 1 is an exploded perspective view of a rotary vane pump including a standard shaft seal.

FIG. 1 illustrates a rotary vane pump 10 that includes a conventional shaft seal 15. The rotary vane compressor 10 includes a housing 20 having a front end 25, a pump cavity 30, and a rear end 35. A rotor 40 includes a plurality of retractable vanes 45 that are positioned within the pump cavity 30. The rotor 40 is coupled to a prime mover such as an aircraft engine such that the rotor 40 rotates within the pump cavity 30 to pump air as required. In preferred constructions, the rotor vanes 45 are formed from a carbon composite or metallized carbon that provides for increased life and reduced wear.

The illustrated pump 10 is a dry pump that operates without internal lubricants. In addition, the metallized carbon material expands when exposed to hydrocarbons. The expansion can cause increased wear and reduced vane life. As such, the shaft seal 15 is provided to reduce the likelihood of hydrocarbons entering the pump cavity 30.

A three-finger drive 50 includes a shaft 55 and three fingers 58 that engage the rotor 40 to drive the rotor 40. The fingers 58 are arranged to impart rotational movement to the rotor 40 while still allowing axial movement between the three-finger drive 50 and the rotor 40.

The conventional shaft seal 15 includes a single bushing 60 positioned adjacent the shaft 55 and inside of the front end 25 of the housing 20. In this position, the bushing 60 is designed to inhibit leakage between the bushing 60 and shaft 55 and between the bushing 60 and front end 25 of the housing 20. However, the design of the bushing 60 is such that any wear of the bushing 60 can reduce the effectiveness of the bushing 60.

Figure 2:
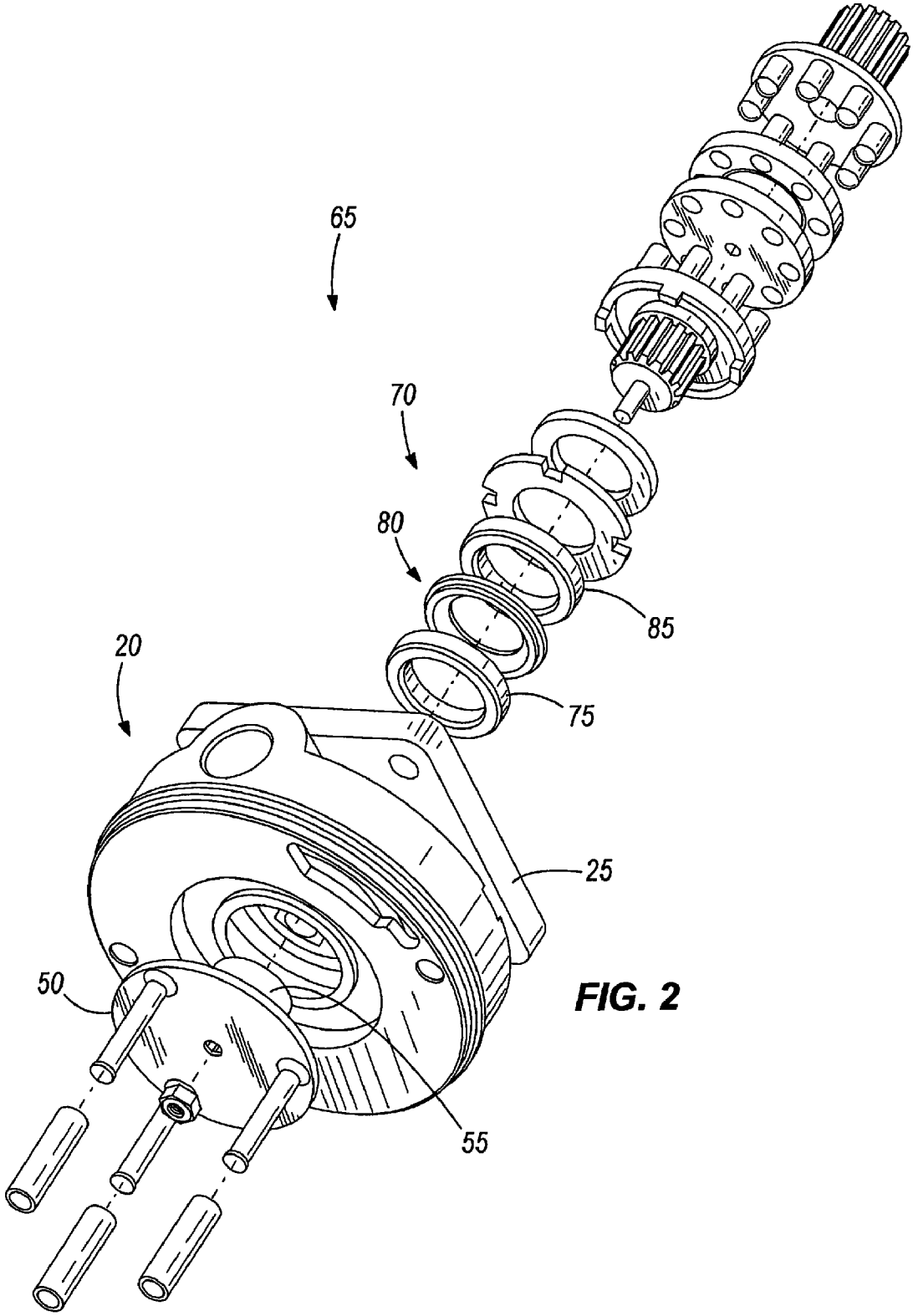
FIG. 2 is an exploded perspective view of a portion of the pump of FIG. 1, including a shaft seal assembly embodying the invention.

FIG. 2 is an exploded view of a rotary vane pump 65 similar to that of FIG. 1 and including a shaft seal assembly 70 of the present invention in place of the conventional shaft seal 15. The shaft seal assembly 70 is positioned on the shaft 55 of the three-finger drive 50 and provides a seal between the seal assembly 70 and the shaft 55 and the seal assembly 70 and the front end 25 of the housing 20.

Figure 3:
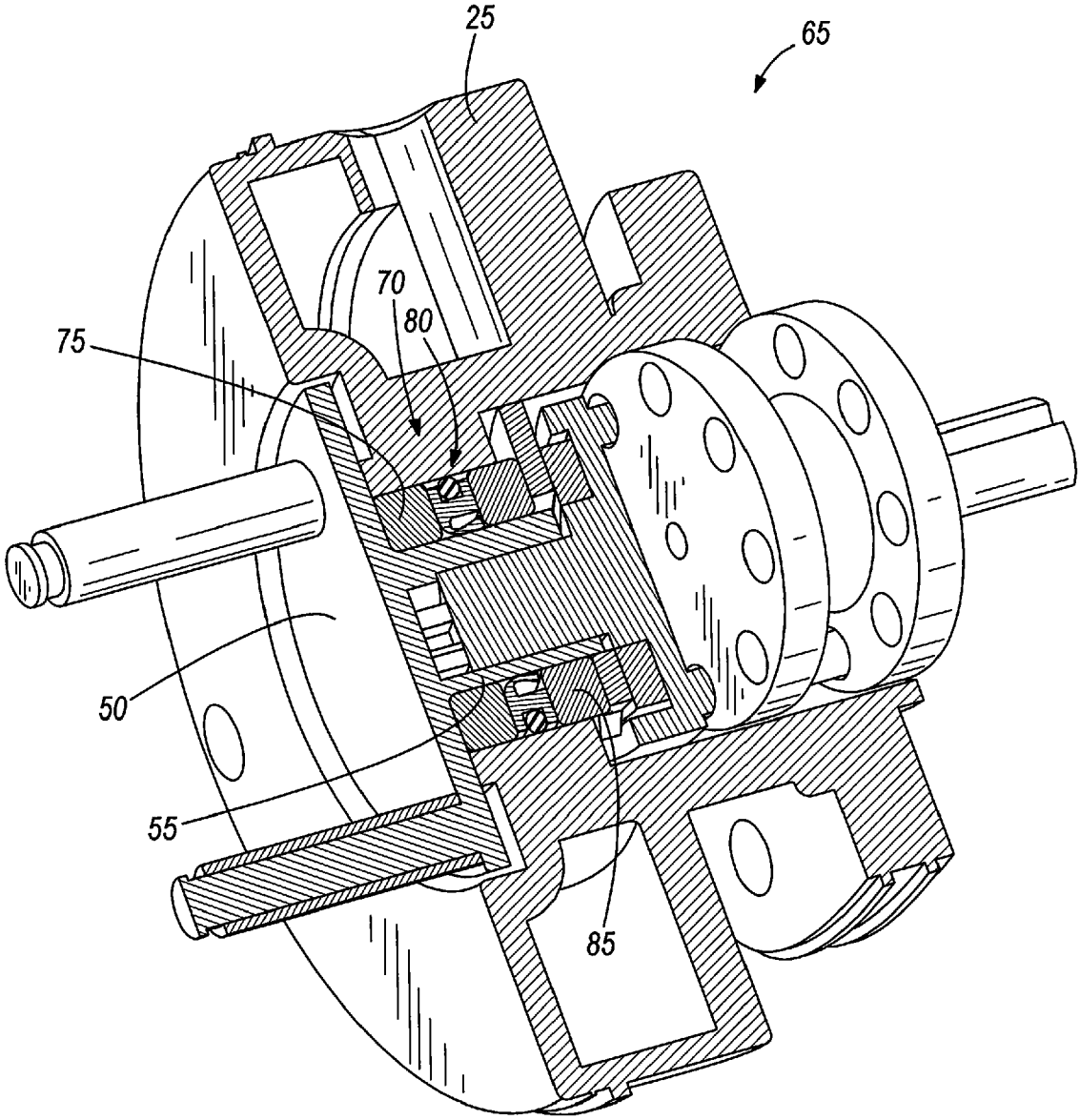
FIG. 3 is a section view of the portion of the pump of FIG. 2 showing the shaft seal assembly in an operating position.

FIG. 3 illustrates the shaft seal assembly 70 in an operating position. It should be noted that the shaft seal assembly 70 includes portions that interfere with the front end 25 of the housing 20 and the shaft 55. These interferences will be discussed in detail below.

Figure 5:
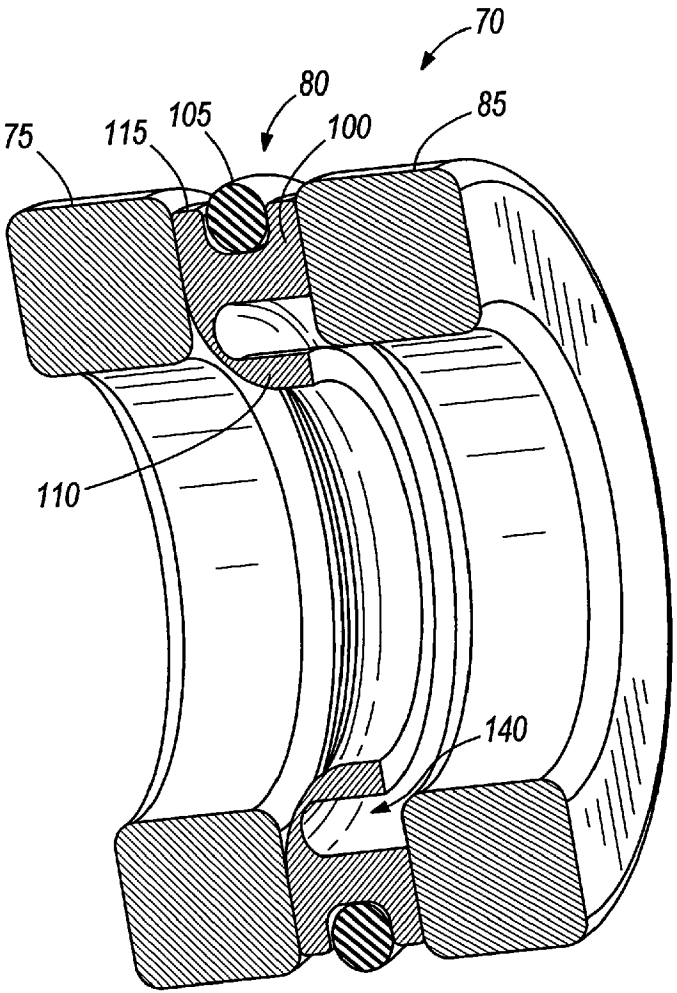
FIG. 5 is a perspective section view of the shaft seal assembly of FIG. 2.
Figure 4:
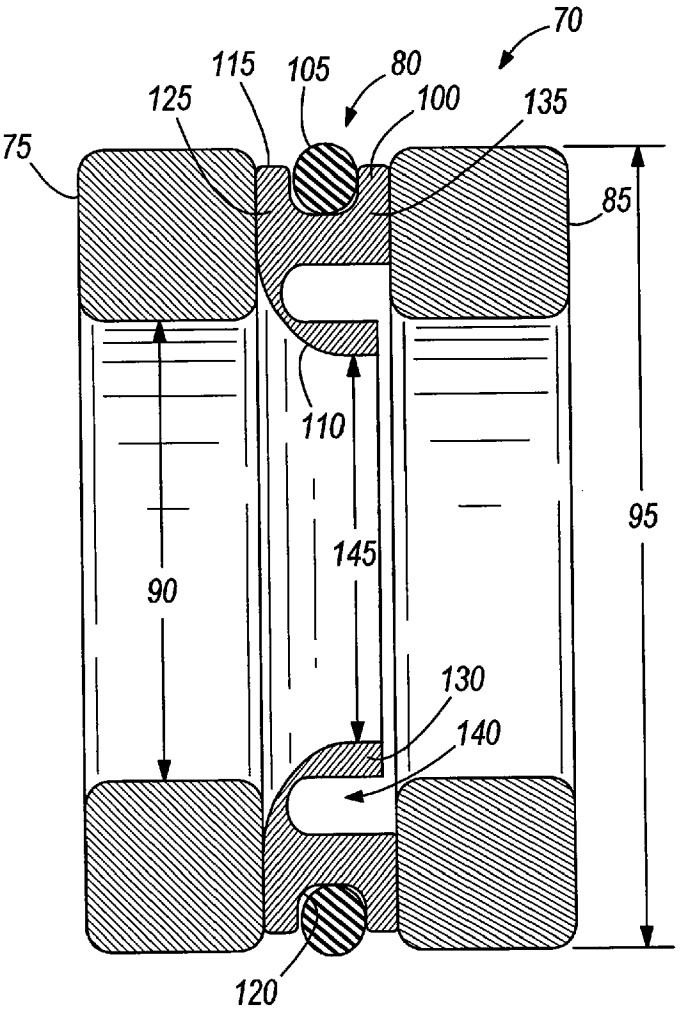
FIG. 4 is a section view of the shaft seal assembly of FIG. 2.
Figure 6:
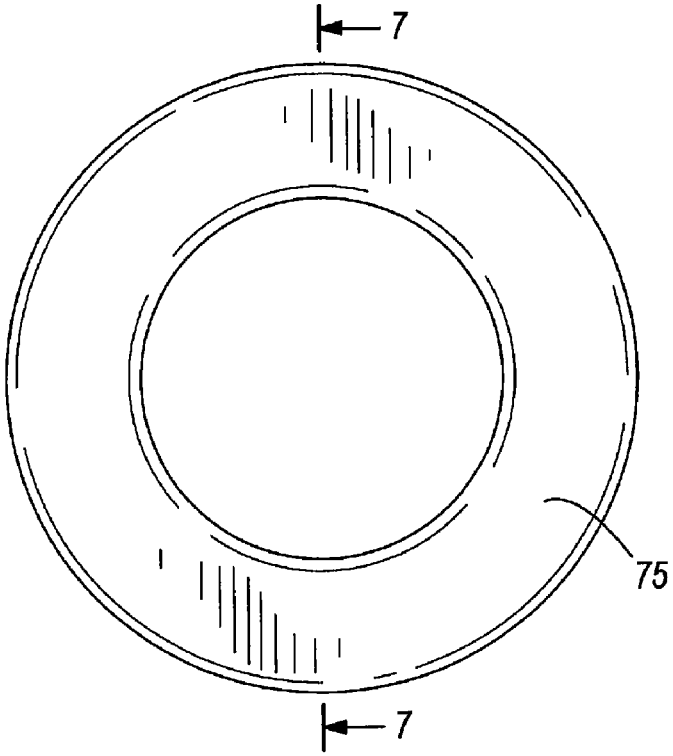
FIG. 6 is a front view of a bushing of the shaft seal assembly of FIG. 2.
Figure 7:
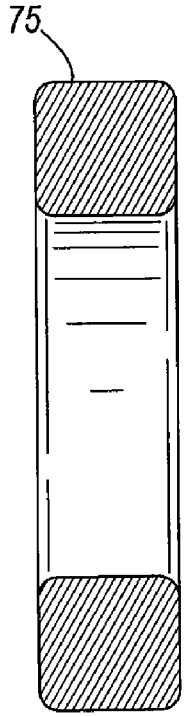
FIG. 7 is a section view of the bushing of FIG. 6 taken along line 7-7 of FIG. 6.

As illustrated in FIGS. 4 and 5, the shaft seal assembly 70 includes a first bushing 75, a dry seal assembly 80, and a second bushing 85. In preferred constructions, the first bushing 75 and the second bushing 85 are similar or even identical with one possible arrangement illustrated in FIGS. 6 and 7. However, other constructions could employ bushings of differing designs. The first bushing 75 and the second bushing 85 are circular members having a substantially rectangular cross-section as illustrated in FIG. 4. The inside diameter 90 of the first bushing 75 and the second bushing 85 are sized to seal against the shaft 55. Similarly, the outside diameter 95 of the first bushing 75 and the second bushing 85 are sized to seal against the front end 25 of the housing 20. In one construction, the bushings 75, 85 are made from a carbon material that is similar to the material used in the conventional shaft seal bushing 60. Of course other materials could be employed as desired.

Figure 8:
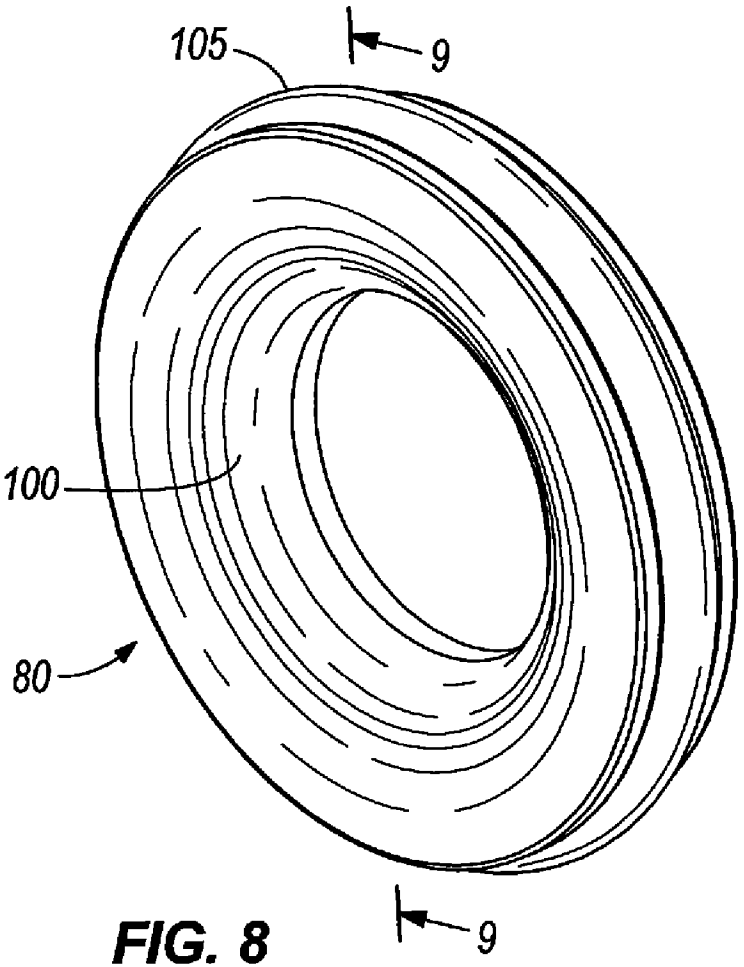
FIG. 8 is a perspective view of a dry seal assembly of the shaft seal assembly of FIG. 2.
Figure 9:
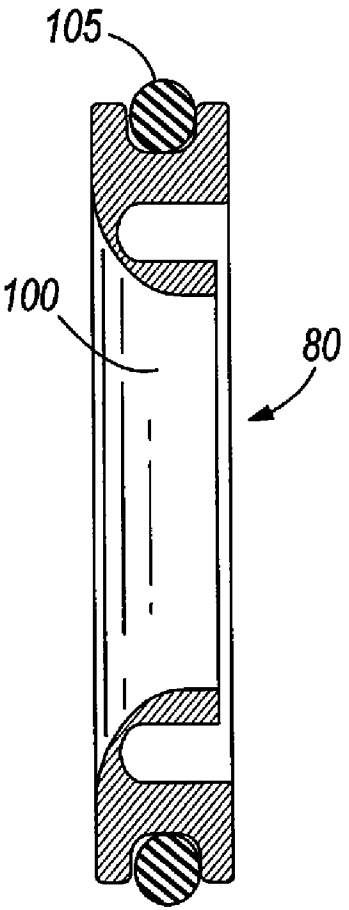
FIG. 9 is a section view of the dry seal assembly of FIG. 8 taken along line 9-9 of FIG. 8.

The dry seal assembly 80, illustrated in FIGS. 8 and 9, is positioned between the first bushing 75 and the second bushing 85 and includes a wiper 100 and an o-ring 105. The wiper 100 includes a tongue 110 and an outer portion 115 having a width that is selected such that the width of the wiper 100, the first bushing 75 and the second bushing 85 cooperate to occupy about the same space as the conventional bushing 60. The outer portion 115 also includes a channel 120 positioned to receive the O-ring 105.

With reference to FIGS. 4 and 5, the tongue 110 extends from a first end 125 of the outer portion 115 and includes an extension portion 130 that extends toward a second end 135 of the outer portion 115. Thus, the tongue 110 and outer portion 115 cooperate to define a U-shaped channel 140 that is open in a direction away from the pump cavity 30. In other words, the U-shaped channel 140 is open in a direction from which likely contaminates will enter the pump cavity 30. The tongue 110 is sized to define an inside diameter 145 that is smaller than the outside diameter of the shaft 55 such that when positioned adjacent the shaft 55, the tongue 110 must deflect. Thus, as illustrated in FIG. 3, the tongue 110 will interfere with the shaft 55 if it does not deflect. The deflection assures that the tongue 110 will contact the shaft 55 during all operating conditions and even as the tongue 110 wears, contact will be maintained. In addition, the tongue 110 is formed and sized to provide a desired contact pressure against the shaft 55.

As mentioned above, the O-ring 105 fits within the channel 120 and is sized to interfere with the front end 25 of the housing 20 such that it must deflect to be installed properly. Thus, as illustrated in FIG. 3, if the O-ring 105 does not deflect, it interferes with the front end 25 of the housing 20.

When positioned as described, the O-ring 105 functions to provide a positive seal between the shaft seal assembly 70 and the front end 25 of the housing 20. In addition, the force between the O-ring 105 and the front 25 of the housing 20 forces the wiper 100 inward until a balance is reached and the desired force between the tongue 110 and shaft 55 is reached. As the tongue 110 wears, the force between the tongue 110 and the shaft 55 is reduced and the O-ring 105 is able to push the wiper 100 inward until the forces once again balance. In this way, the dry seal assembly 80 is able to maintain contact between the tongue 110 and the shaft 55 even as the tongue 110 wears.

In some constructions, the wiper 100 is formed from a PTFE material (polytetra fluoroethylene, TEFLON). However, preferred constructions employ a composite material such as a graphite PTFE combination. In one construction, the wiper 100 is formed from a material that is 10 percent graphite and 90 percent PTFE. Of course other materials could be employed if desired.

The shaft seal assembly 70 is configured such that it can be used to replace the prior shaft seal bushing 60 if desired. In one use, an existing pump 10 is disassembled and the bushing 60 is removed. The first bushing 75, the dry seal assembly 80, and the second bushing 85 are positioned in the front end 25 of the housing 20 and the pump 10 is reassembled with the new shaft seal assembly 70. The shaft seal assembly 70 provides positive contact with the shaft 55 and with the front end 25 of the housing 20 to improve the seal at the shaft 55 and reduce the likelihood of contaminates entering the pump cavity 30.

Thus, the invention provides, among other things, a new and useful shaft seal assembly 70 for use in a rotary vane pump 10, 65. The shaft seal assembly 70 can be used, among other things, to replace a conventional shaft seal bushing 60 to enhance seal performance.

I claim:

1. A pump comprising:

a housing;

a shaft rotatable about an axis, the shaft having a shaft diameter and having a portion disposed within the housing;

a rotor coupled to the shaft and rotatable about a rotational axis with the shaft;

a plurality of retractable vanes coupled to the rotor, each vane including a first end that contacts the housing;

a seal element positioned to define a seal between the shaft and the housing, the seal element including a first bushing, a second bushing, and a dry seal assembly including a wiper that defines a diameter that is smaller than the shaft diameter, wherein the dry seal assembly is positioned between and in contact with the first bushing and the second bushing.

2. The pump of claim 1, wherein the first bushing is a substantially annular ring having a substantially rectangular cross-section.

3. The pump of claim 1, wherein the first bushing and the second bushing are substantially the same.

4. The pump of claim 1, wherein the first bushing includes an outermost surface that cooperates with the housing to define a first seal and an innermost surface that cooperates with the shaft to define a second seal.

5. The pump of claim 1, wherein the wiper includes an outermost surface that is spaced a non-zero distance from the housing.

6. The pump of claim 5, further comprising a biasing member positioned between the housing and the wiper and operable to bias the wiper toward the shaft.

7. The pump of claim 6, wherein the biasing member includes an O-ring.

8. The pump of claim 1, wherein the wiper includes an outer portion and a tongue extending inward from the outer portion, the tongue in contact with the shaft.

9. The pump of claim 8, wherein the tongue deflects in response to contact with the shaft to compensate for wear of the tongue and shaft.

10. The pump of claim 8, wherein the outer portion and the tongue cooperate to define a U-shaped channel having an open end that faces away from the retractable vanes.

11. A pump comprising:

a housing defining a pump space and a seal space;

a shaft including a seal portion positioned adjacent the seal space;

a rotor coupled to the shaft and rotatable about a rotational axis with the shaft;

a plurality of vanes retractably supported by the rotor, each vane including a first end that contacts the pump space;

a first bushing positioned between the shaft and the housing within the seal space;

a second bushing positioned between the shaft and the housing within the seal space, the second bushing spaced a non-zero distance along the axis from the first bushing;

a wiper disposed between the first bushing and the second bushing, the wiper including an innermost surface that contacts the shaft and an outermost surface spaced a non-zero distance from the housing; and a biasing member positioned between the wiper and the housing and in contact with the outermost surface of the wiper and the housing to bias the wiper toward the shaft.

12. The pump of claim 11, wherein the first bushing is a substantially annular ring having a substantially rectangular cross-section.

13. The pump of claim 11, wherein the first bushing and the second bushing are substantially the same.

14. The pump of claim 11, wherein the first bushing includes an outermost surface that cooperates with the housing to define a first seal and an innermost surface that cooperates with the shaft to define a second seal.

15. The pump of claim 11, wherein the biasing member includes an O-ring that forms a seal with the wiper and the housing.

16. The pump of claim 11, wherein the wiper includes an outer portion and a tongue extending inward from the outer portion, the tongue in contact with the shaft.

17. The pump of claim 16, wherein the tongue deflects in response to contact with the shaft to compensate for wear of the tongue and shaft.

18. The pump of claim 16, wherein the outer portion and the tongue cooperate to define a U-shaped channel having an open end that faces away from the pump space.

* * * * *